US005797206A

United States Patent [19]

Vitorino

[11] Patent Number: 5,797,206

[45] Date of Patent: Aug. 25, 1998

[54] METHOD FOR REVERSIBLY CONVERTING A TRADITIONAL DOUBLE ACTION PISTOL TO A SINGLE ACTION, TARGET PISTOL

[75] Inventor: Olimpio Vitorino, Ludlow, Mass.

[73] Assignee: Smith & Wesson Corp., Springfield, Mass.

[21] Appl. No.: 780,170

[22] Filed: Dec. 26, 1996

[51] Int. Cl.[6] ..... F41A 3/00; F41A 5/00

[52] U.S. Cl. ..... 42/69.03; 42/69.01; 89/144; 89/147

[58] Field of Search ..... 42/69.03, 69.02, 42/69.01, 65; 89/147, 144, 146; 29/1.1, 1.11

[56] References Cited

U.S. PATENT DOCUMENTS

| | | | |
|---|---|---|---|
| 2,626,476 | 1/1953 | Miller | 42/69.03 |
| 2,846,925 | 8/1958 | Norman | 89/145 |
| 3,152,418 | 10/1964 | Charron | 42/69.03 |
| 3,722,358 | 3/1973 | Seecamp | 89/147 |
| 4,275,640 | 6/1981 | Wilhelm | 89/147 |
| 4,625,443 | 12/1986 | Beretta | 42/69.01 |
| 4,671,005 | 6/1987 | Jewell | 42/69.02 |
| 5,160,796 | 11/1992 | Tuma et al. | 42/69.03 |

*Primary Examiner*—Michael J. Carone
*Assistant Examiner*—Theresa M. Wesson
*Attorney, Agent, or Firm*—McCormick, Paulding & Huber

[57] ABSTRACT

A method of reversibly converting pistols that have been manufactured as double action pistols to single action, target pistols. The double action pistols have an initial trigger stroke for the double action performance thereof. The length of the trigger stroke is substantially reduced by the removable placement of an abutment between opposed portions of the trigger and the frame, i.e., to the top of the trigger, to substantially shorten the full length of the trigger stroke. The hammer is modified to include an intermediate notch of sufficient depth and positioned to serve as a safety in the event that the hammer is dislodged in its fully cocked position. Any other mechanisms that inhibit the conversion to single action are removed, depending upon the pistol's structure. Such mechanisms may include the firing pin safety mechanism. The trigger, sear and hammer may be modified by replacement with parts having the desired features.

10 Claims, 5 Drawing Sheets

METHOD FOR REVERSIBLY CONVERTING A TRADITIONAL DOUBLE ACTION PISTOL TO A SINGLE ACTION, TARGET PISTOL

BACKGROUND OF THE INVENTION

The present invention relates to traditional double action pistols, and more particularly to a method for reversibly converting a traditional double action pistol to operate as a single action pistol.

Traditional double action pistols are widely used as a "duty gun", for example by law enforcement personnel throughout the country, and may also be used for recreational purposes. Such pistols are characterized by an initial, longer and heavier trigger stroke, which cocks the hammer, fires the pistol and results in the hammer being re-cocked. Subsequent trigger pulls fire subsequent shots, but the subsequent trigger strokes may be shorter, as the hammer is already cocked. Examples of the traditional double action pistols includes the Model 4506 and 5906 pistols and other handguns manufactured by Smith & Wesson Corp. of Springfield, Mass., the assignee of the present invention.

Due to the longer, heavier first pull of traditional double action pistols, these pistols are not generally used for target shooting, where shorter, lighter and consistent trigger strokes are preferred. Consequently, persons owning traditional double action pistols may also purchase a single action pistol for target shooting, or may forego target shooting altogether. In the alternative, some pistols which were manufactured as traditional double action are converted to single action by skilled gunsmiths.

Known conversions for modifying traditional double action pistols to single action include permanent modifications to the pistol. Typical modifications include the drilling of blind holes in the frame to reposition the trigger, and permanent modifications to other parts of the pistol, e.g., the hammer or sear assembly. The modifications can be expensive, and permanent modifications are made to various components of the pistols during the modification process. As a result of these permanent modifications, it is not feasible to re-convert a converted pistol to stock, or reverse the conversion to return the pistol to traditional double action.

It would be desirable to convert a traditional double action pistol to operate as a single action pistol at low cost and without the drawbacks and disadvantages of known conversions.

SUMMARY OF THE INVENTION

According to one aspect of the present invention, a method is disclosed for reversibly converting pistols that have been manufactured as double action pistols to single action, target pistols both in an economical manner. The double action pistols have a longer initial trigger stroke, followed either by shorter strokes or long strokes, for the double action performance thereof.

The method includes substantially decreasing the length of the trigger stroke by the removable placement of an abutment between opposed portions of the trigger and the frame to substantially shorten the full length of the trigger stroke. Preferably, the abutment is positioned so as to be concealed within the pistol. Another aspect of the method is modifying the hammer to include an intermediate notch of sufficient depth and positioned to serve as a safety in the event that the hammer is dislodged from its fully cocked position. The method also includes removing other mechanisms that tend to inhibit the conversion to single action.

In one instance, the length of the trigger stroke is reduced by the removable replacement of the trigger with another trigger having an abutment which is positioned between an upper portion of the trigger and the associated portion of the frame when the replacement trigger is mounted in the frame. The length of the trigger stroke for firing the pistol is reduced accordingly. In another instance, the firing pin safety is also removed.

One advantage of the present invention is that the conversion is truly reversible. In other words, once the pistol is converted from traditional double action to single action in accordance with the present invention, the pistol may thereafter be re-converted to traditional double action.

Another advantage of the present invention is that the conversion is reversible, and when re-converted, the pistol is returned to precisely the same condition in which it was prior to the conversion. No permanent modifications are made to the frame or slide of the pistol or its original components.

Still another advantage is that the present invention allows owners of "duty or service type", traditional double action pistols to convert the pistols to single action, target pistols at low cost and minimal inconvenience to the owner, without the expense of purchasing an additional pistol.

Yet another advantage is that, although the present invention should be performed by skilled artisans, the conversion parts are relatively uncomplicated and inexpensive, and the present invention is easily replicated at the factory from pistol to pistol.

Additional advantages will become apparent to those skilled in the art based upon the following description and accompanying drawings.

DETAILED DESCRIPTION OF THE PREFERRED EMBODIMENT

Figure 1:
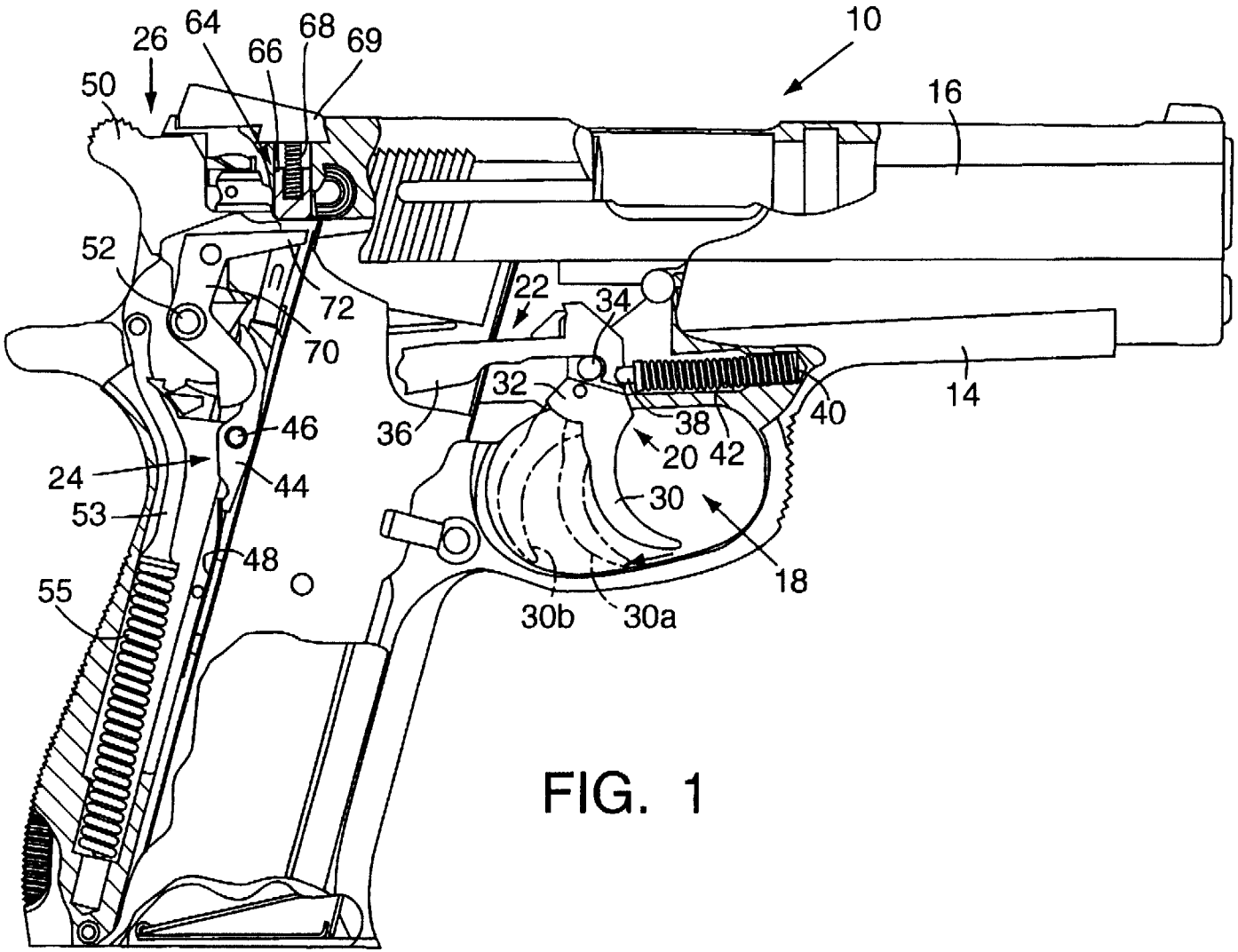
FIG. 1 is a side view, partially in section, of a third generation, traditional double action pistol manufactured by the assignee of the present invention.
Figure 4A:
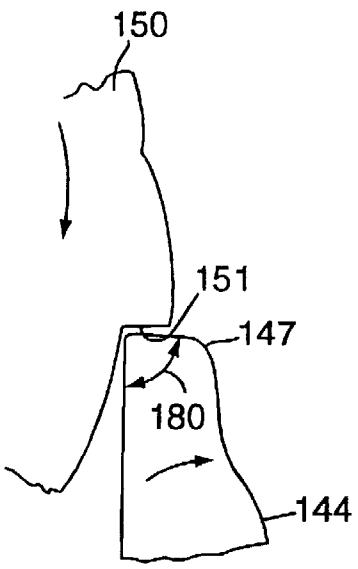
FIGS. 4*a* and 4*b* are a fragmentary views of a sear nose in accordance with the present invention and a conventional sear nose.
Figure 4B:
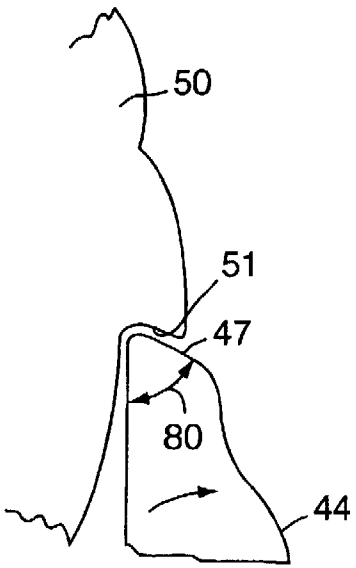
Figure 4:
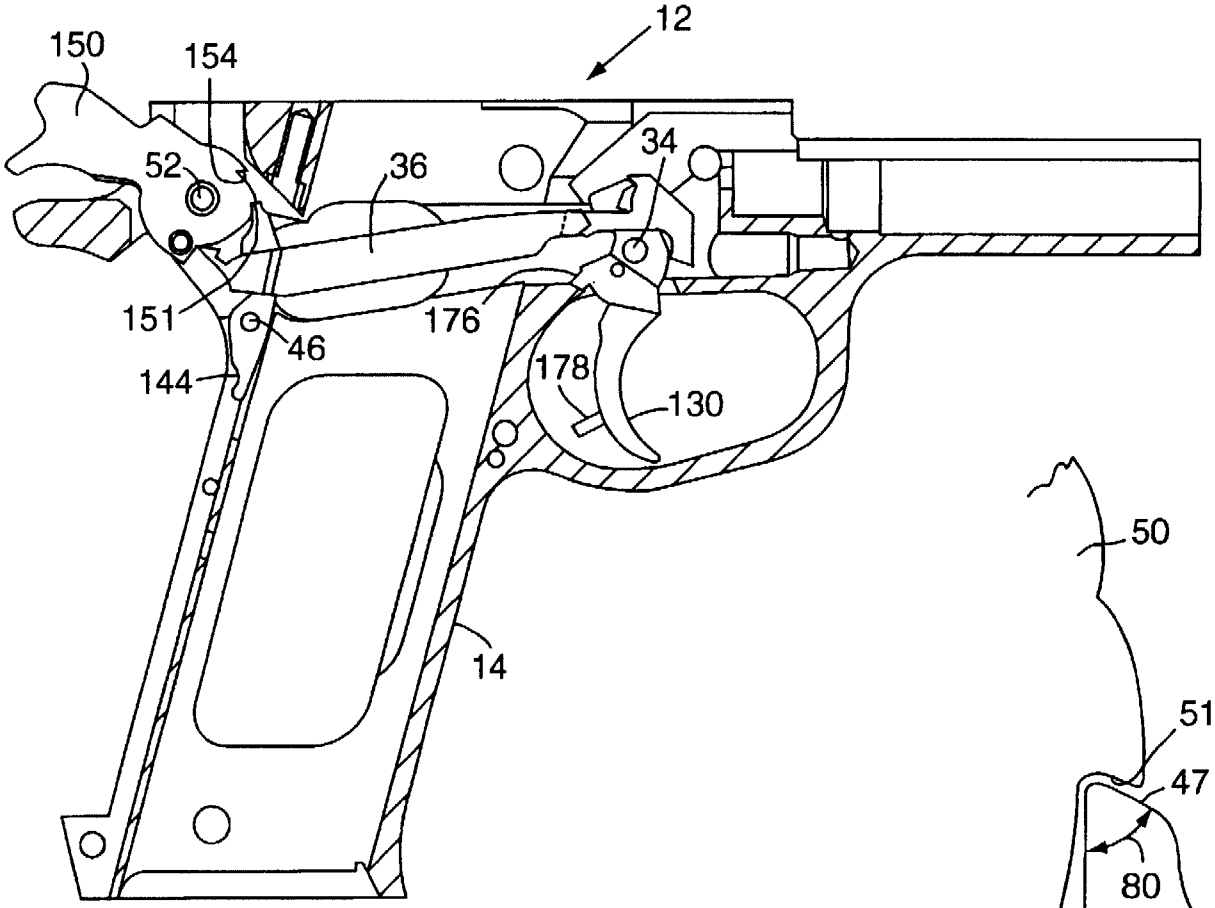
FIG. 4 is a side, sectional view of a pistol with its slide removed, which has been modified to operate with a single action in accordance with the present invention, illustrating the trigger in a forward position and the hammer cocked.
Figure 5:
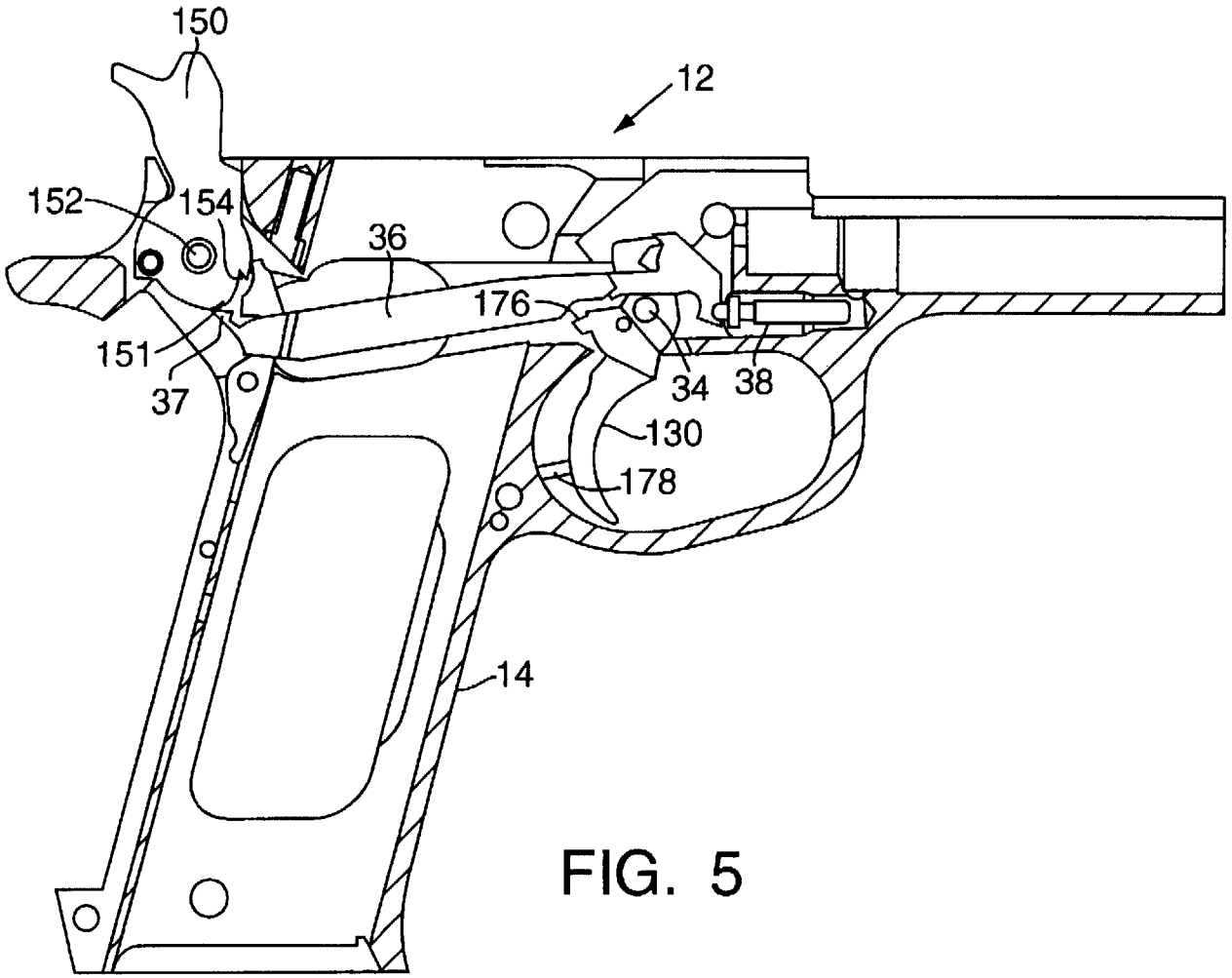
FIG. 5 is a view similar to FIG. 3, with the trigger in a rearward, actuated position and the hammer de-cocked.

In FIG. 1, a traditional double action pistol is illustrated generally by the reference numeral 10. Such a pistol is shown in U.S. Pat. No. 2,846,925 to Norman, which is assigned to the assignee of the present invention and is expressly incorporated herein by reference. A pistol in accordance with the present invention is illustrated in FIGS. 4 and 5 by the reference numeral 12. As used herein, the phrase "traditional double action" refers to a pistol in which the first shot requires a single, heavier pull of the trigger to cock the hammer and fire the pistol. The first trigger stroke is relatively long. For subsequent shots, the hammer is already cocked, and the trigger stroke may be the same length or shorter, and lighter, and may also vary depending upon the make and model of the pistol. "Single action" refers to a pistol in which the hammer must be cocked before the trigger is pulled to fire the pistol. In a pistol, the hammer need only be manually cocked prior to the first shot.

The traditional double action pistol 12 illustrated in FIG. 1 includes a frame 14, a slide assembly 16 which recoils along the frame when the pistol is fired, and a firing mechanism 18. The firing mechanism in turn includes a trigger 20, draw bar 22, sear 24, hammer 26, and firing pin 28 (FIG. 3*a*) assemblies, each of which operates in a known manner. The trigger assembly 20 includes a trigger 30 having a top portion 32 and mounted to the frame 14 by a trigger pin 34. The draw bar assembly 22 includes a draw bar 36, and a draw bar plunger 38 and draw bar spring 40 received in a cavity 42 in the frame 14. The draw bar 36 cooperates with the trigger 30 and moves forward, that is left to right as viewed in FIG. 1, when the trigger is moved from the position indicated in solid lines to the position 30*b* indicated in dashed lines, to cock the hammer, as described below.

Figure 2:
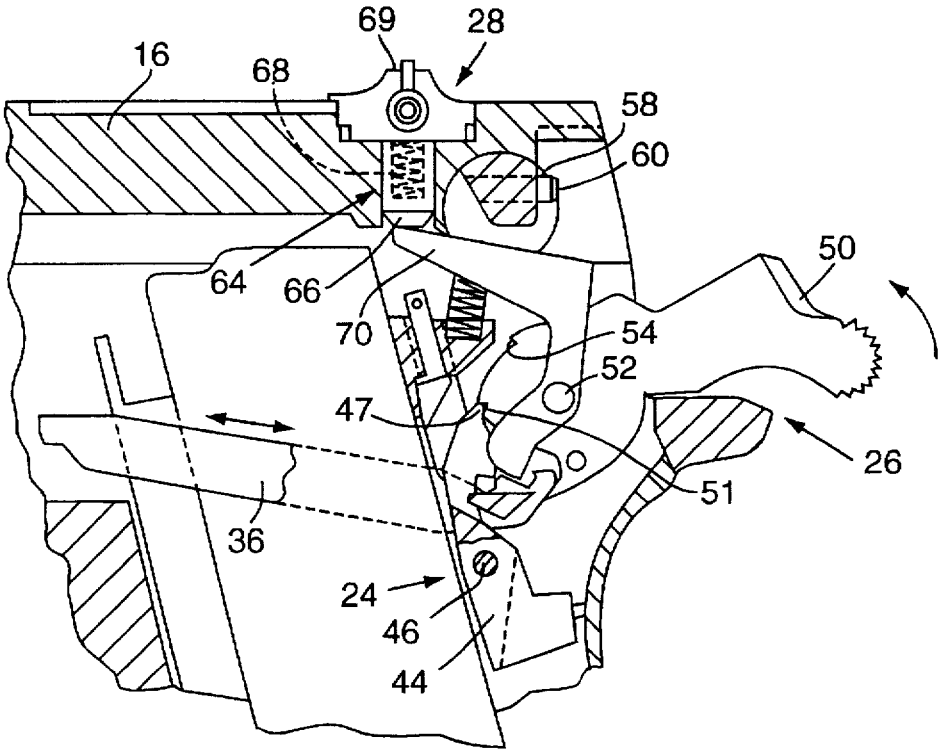
FIG. 2 is a fragmentary view in section of the pistol of FIG. 1, illustrating portions of a firing mechanism and a hammer in a full cocked position.
Figure 3:
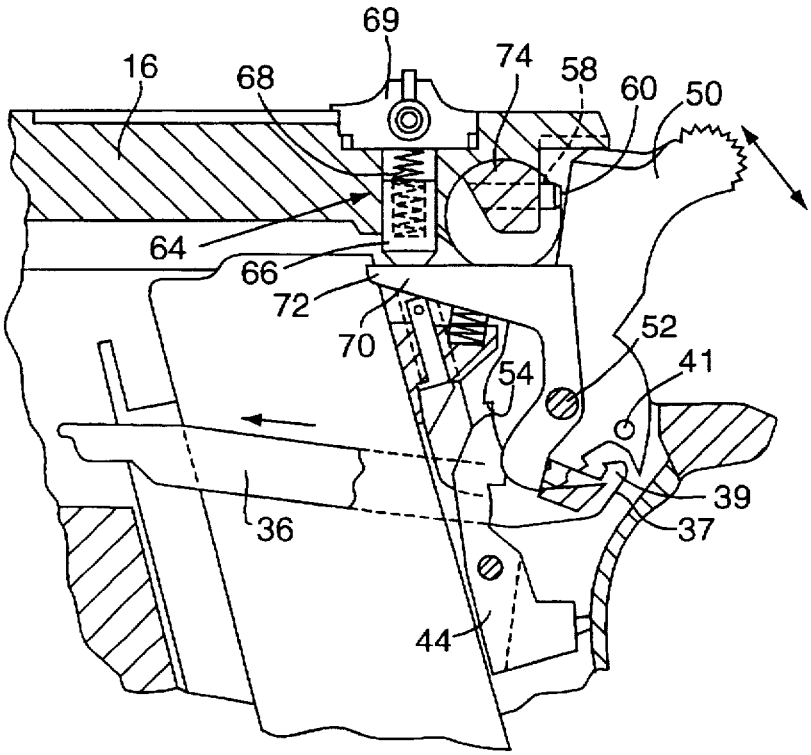
FIG. 3 is a view similar to FIG. 2, but illustrating a firing pin safety lever, and the hammer in a half-cocked position.

With reference to FIGS. 1–3, the sear assembly 24 includes a sear 44 which is rotatably mounted to the frame 14 between first and second positions by a sear pin 46, and a leaf-type sear spring 48 which is also mounted to the frame and biases the sear pin into the first position shown in FIG. 1. The sear, specifically the nose 47 of the sear, cooperates with notches in the hammer (discussed below), to releasably hold the hammer in a cocked position, as is known in the art.

The hammer assembly 26 includes a hammer 50, which has at least a full cock notch 51 and is rotatably mounted to the frame 14 between first and second limit positions illustrated in FIGS. 1 and 2 by a hammer pin 52. A stirrup 53 and mainspring 55 (FIG. 1) are connected to the hammer, for providing the energy to rotate the hammer from a cocked to firing position, as is described below. In the first position, illustrated in FIG. 1, the hammer is in a de-cocked position. As illustrated in FIG. 3, an end 37 of the draw bar 36 includes a claw 39 which cooperates with corresponding notches 41 on the hammer 50 to cock the hammer. In the second position, illustrated in FIG. 2, the hammer is in a cocked, or ready to fire position, and the mainspring (not shown in FIGS. 2 and 3) is compressed, thereby storing energy for pivoting the hammer when the trigger is pulled.

While most "third generation", traditional double action pistols manufactured by the assignee of the present invention typically only have a full cock notch, it is known from the above-identified U.S. Pat. to provide a hammer which also has a half-cock notch 54. The half cock notch 54 is deeper than the full-cock notch 51, and serves as a safety in the event that the hammer is accidentally dislodged from its full cocked position. In that event, the half cock notch is provided to catch the nose 47 of the sear 44, which prevents firing of the pistol. However, when the trigger is actuated, in the direction of the arrow in FIG. 1, the sear is pivoted away from the path of the full 51 and half 54 cock notches of the hammer 50, to enable firing of the pistol.

As shown in FIG. 2, in the second or cocked position, the nose 47 of the sear 44 is lodged in the full cock notch 51 of the hammer 50. As a result of subsequent actuation of the trigger, the nose 47 of the sear 44 pivots away from the full cock notch 51 of the hammer 50, and the hammer rotates rapidly and cooperates with the firing pin mechanism 28, described below, thereby firing the pistol.

Figure 3A:
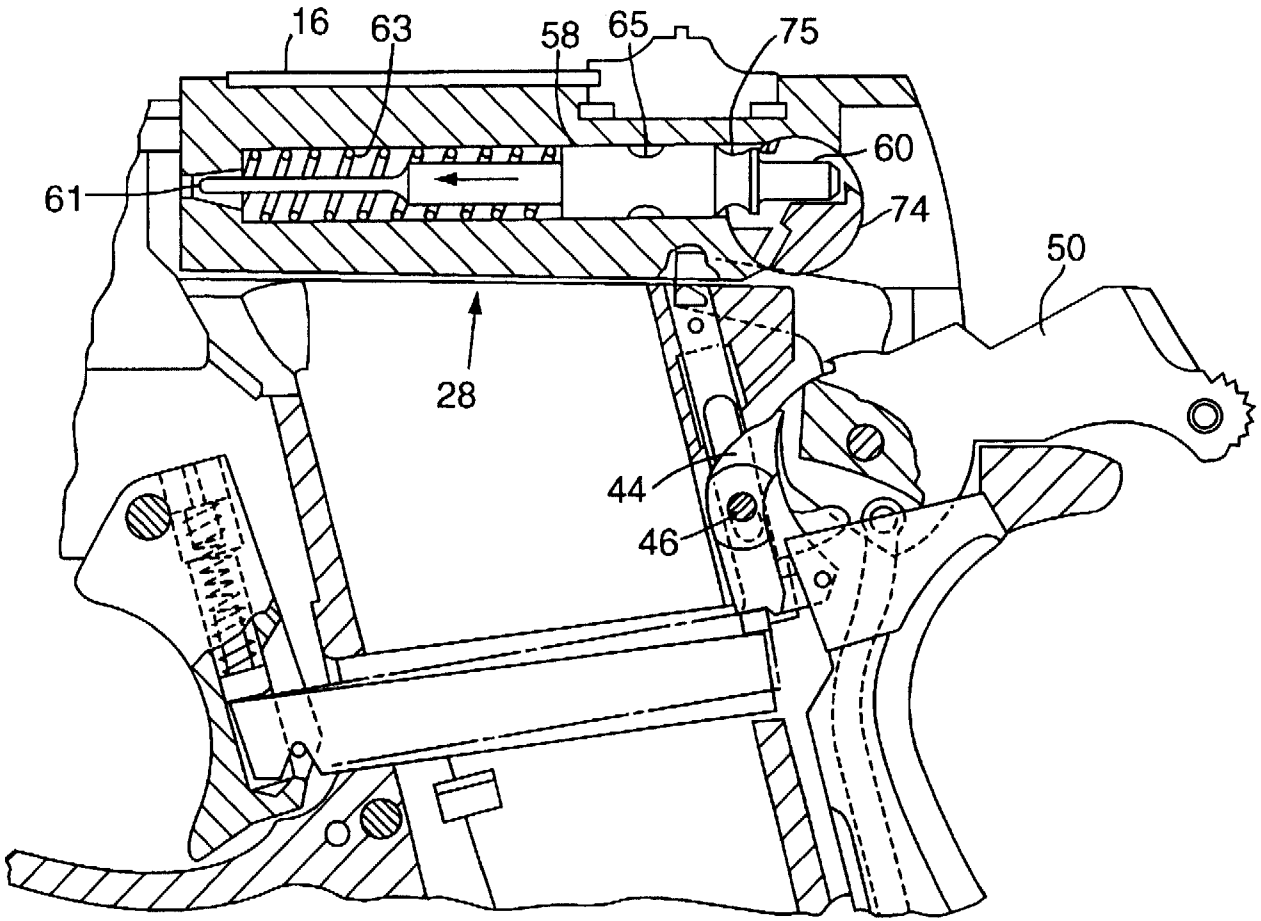
FIG. 3*a* is a view similar to FIGS. 2 and 3, but illustrating a firing pin mechanism.

Turning to FIG. 3*a*, the firing pin mechanism 28 includes a firing pin 58 having a rearward end 60 adjacent to the hammer 50, and a forward end 61 adjacent to a chambered cartridge (not shown). The firing pin 58 is biased rearwardly by a firing pin return spring 63. The firing pin return spring causes the firing pin to move from a fired position to the position illustrated in FIG. 3*a* in order to fire the next round.

In FIGS. 2 and 3, a firing pin safety mechanism 64 prevents movement of the firing pin, and particularly movement toward a chambered cartridge, when the trigger is not pulled. The firing pin safety mechanism includes a firing pin plunger 66 and firing pin return spring 68, which are movably received in a cavity in the slide 16 located under a rear sight 69 of the pistol. The firing pin plunger spring 68 biases the plunger down, where it cooperates with a notch 65 (FIG. 3*a*) in the firing pin, to lock the firing pin and prevent firing the pistol. The firing pin safety mechanism 64 also includes a firing pin safety lever 70, which is pivotally mounted on the frame 14 by the hammer pin 52 and has an end 72 (FIGS. 1 and 3) adjacent to the firing pin safety plunger 66. Upon movement of the trigger 30, the end 72 of firing pin safety lever 70 is moved upwardly to compress the firing pin plunger spring 68 and move the firing pin safety plunger 66 away from the firing pin 58, to enable movement of the firing pin and firing of the pistol. Additional safety features include a decocking lever 74 and corresponding additional notch 75 (FIG. 3*a*) on the firing pin 58, the operation of which is known and is generally described in the above U.S. Pat. No. 2,846,925.

The traditional double action pistol begins operation as illustrated in FIG. 1, with the trigger in the position indicated by the solid line, and the hammer in the indicated, de-cocked position. During the initial portion of a first trigger stroke, as indicated by the broken line 30*a* in FIG. 1, the draw bar 36 is moved forward in the pistol, as indicated by the arrows on the draw bar in FIGS. 1 and 2. The claw 39 at the end 37 of the draw bar catches the associated notch in the hammer 50, and begins to pivot the hammer toward the cocked position. As the trigger 30 is pulled to the position indicated by the broken lines 30*a* in FIG. 1, the hammer 50 is moved into the full-cocked position indicated in FIG. 2, the nose 47 of the sear 44 abuts the full cock notch 51, and the pistol is ready to fire.

As the trigger is actuated from the position indicated by the broken lines 30*a* in FIG. 1 to the firing position indicated by the broken lines 30*b*, the end 37 of the draw bar abuts the sear 44, and pivots the sear to move the sear nose from the full cock notch 51 of the hammer 50, thereby releasing the hammer and striking the firing pin. At the same time, movement of the draw bar 36 also rotates the firing pin safety lever 70 so that the end 72 moves the firing pin safety plunger 66 upwardly out of the notch in the firing pin 58, and enables movement of the firing pin to strike a chambered cartridge and fire the pistol. After firing, the slide 16 recoils and recocks the hammer 50. Thereafter, any movement of the trigger between the positions 30 and 30*a* does not cock the hammer, as the hammer is already cocked.

Turning now to FIGS. 4 and 5, a pistol that is converted from a traditional double action to single action by the present method is indicated by the reference numeral 12. The converted pistol is in many way similar to the pistol shown and described in FIGS. 1–3, and like reference numerals are used for like elements. The converted pistol differs from the pistol 10 shown in FIGS. 1–3 in that the hammer, sear and trigger are replaced or modified with parts having different configurations to enable the pistol to fire with a single action. The method of conversion is uncomplicated, inexpensive and easily replaced and reversed.

To reversibly convert the pistol 10 shown in FIGS. 1–3, the pistol is disassembled as needed to remove the trigger 30, sear 44 and hammer 50 and firing pin safety mechanism 64, as is described below.

As shown in FIGS. 4 and 5, the trigger pin 34 is removed, and the trigger 30 is replaced with a trigger 130 of significantly different design. Since the hammer is manually cocked in a single action pistol, and thus the hammer is not cocked by pulling the trigger, a typical single action trigger stroke is much shorter that the traditional double action trigger stroke. In order to shorten the double action trigger pull into a single action trigger pull, an abutment 176 is disposed between the upper portion of the trigger 130 and the adjacent portion of the frame 14, and in the illustrated embodiment the abutment 176 is formed on the trigger 130. The abutment 176 is positioned so that the forward position of the trigger is positioned rearwardly of the position 30 illustrated in FIG. 1. In the illustrated embodiment, the abutment reduces the length of the trigger stroke by about 80%, although different lengths are possible. By positioning the abutment on a replaceable trigger rather than on the frame, the pistol can be returned to its original condition, i.e., back to traditional double action pistol, at a later date if desired. Moreover, the abutment 176 is concealed within the frame of pistol. The abutment 176 moves the first limit position (30 in FIG. 1) of the trigger backwards to a position just behind the position 30*a* of the trigger shown in FIG. 1, that is, between the position 30*a* and the position 30*b*. The trigger also includes a projection 178 near the bottom of the trigger 130. The projection 178 prevents the trigger from being pulled back past a point (FIG. 5) once the pistol is fired, which point is forward from the second limit position 30*b* shown in FIG. 1. While it is also possible to drill the original trigger 30 and tap pins into the trigger, it is preferred to replace the trigger, so that the converted pistol may be restored to its original condition at a later date, if desired.

The sear pin 46 is removed, and the sear 44 is also replaced with a sear 144 having a different configuration. With reference to FIGS. 4*a* and 4*b*, the replacement sear 144 is flatter than the sear 44. Specifically, an angle 180 formed by the edges of the nose 147 of the sear 144 is closer to perpendicular than an angle 80 formed on the nose 47 of the original sear 44. In the third generation, traditional double action pistols, the sear angle is roughly 75°. The replacement sear 144 defines an angle of about 85°. The angle is an approximate, and may be different depending upon the type of pistol. Since the angle 180 corresponds to the portion of the sear 144 that cooperates with the notches in the hammer, the flatter angle contributes to some reduction of the force needed to pull the trigger and fire the pistol. A lighter trigger pull is a desirable characteristic of a single action target pistol.

As discussed above, the hammer 50 of a third generation traditional double action pistol has only a full cock notch 51. The hammer 50 is replaced with a hammer 150 having a full cock notch 151 and also a half cock notch 154. The full cock notch of the replacement trigger 150 is more shallow than its counterpart in the original hammer 50, which permits a shorter portion of a trigger stroke to fire the pistol. The half cock notch 151 acts as a safety, as previously discussed above.

The forward trigger position 130 of the converted, single action pistol illustrated in FIG. 5 is behind the first limit position 30 of the conventional double action trigger of FIGS. 1–3. As also discussed above, as the trigger is moved between positions 30*a* and 30*b*, the end 72 of the firing pin safety lever 70 is rotated upwardly to move the firing pin safety plunger 66 and enable actuation of the firing pin 58.

Since the first limit position of the converted trigger 130 is moved back, the draw bar 36 is moved forward, and causes the end 72 safety pin release lever 70 to pivot up. As a result, it would be difficult or impossible to re-mount the slide 16 on the frame 14 of the pistol. Even if the slide were mounted, the end of the lever 70 would move the firing pin safety plunger 66 out of engagement with the firing pin, rendering the firing pin safety mechanism 64 inoperative as a safety. Consequently, the firing pin safety mechanism 64 is removed, including the firing pin safety plunger 66 and associated spring 68 from the slide 16, and the firing pin safety lever 70 from the frame 14. If there are levers or mechanisms adjacent to the firing pin safety lever 70, such as a de-cocking lever, a washer or dummy lever replaces the firing pin safety lever to permit proper operation of any remaining levers. Preferably, a notation is placed on the pistol to alert a user that the manual safety should always be used, and also about the removal of the firing pin safety mechanism.

The converted pistol operates similar to other pistols manufactured as a single action pistol. The hammer 150 must be manually cocked, as indicated in FIG. 4. Each trigger stroke is consistent, short and light, compared to the trigger strokes of a traditional double action pistol. Upon firing the pistol, the hammer must be in the cocked position prior to each subsequent shot.

The present invention provides for significant advantages over known conversions. The present invention allows owners of "duty type", traditional double action pistols to convert the pistols to single action target pistols without the expense of purchasing an additional pistol. Also, the conversion is reversible, i.e., once converted from traditional double action to single action, the pistol may thereafter be restored precisely to its former condition. However, unlike known conversions, the present invention is not only reversible, but no permanent modifications are made to the pistol or its components. Accordingly, when unconverted, the pistol is returned to precisely the same condition in which it was prior to the conversion.

While preferred embodiments have been shown and described, various modifications and substitutions may be made without departing from the spirit and scope of the invention. Accordingly, it is to be understood that the present invention has been described by way of example and not by limitation.

What is claimed is:

1. Method of reversibly converting pistols that have been manufactured and sold as double action pistols to single action, target pistols, the double action pistols having a longer, initial trigger stroke, followed either by shorter strokes or long strokes, for the double action performance thereof, the method comprising the steps of:

substantially decreasing the length of the trigger stroke by the removable placement of an abutment between opposed portions of the trigger and the frame to substantially shorten the full length of the trigger stroke;

modifying the hammer to include an intermediate notch positioned to serve as a safety in the event that the hammer is dislodged in its fully cocked position; and by removing at least any firing pin safety mechanism and any other mechanism which may inhibit the single action operation of the pistol.

2. Method of claim 1 wherein the length of the trigger stroke is reduced by the removable insertion of an abutment on an upper portion of the trigger for abutting said opposed portion of the frame so that length of the trigger stroke for firing said pistol is reduced.

3. Method of claim 1 wherein the firing pin safety is removed.

4. Method of claim 1, wherein the step of decreasing the length of the trigger stroke includes concealably placing the abutment in the pistol.

5. Method of claim 1, wherein the step of modifying the hammer includes replacing the hammer having an intermediate notch of sufficient depth and positioned to serve as a safety in the event that the hammer is dislodged in its fully cocked position.

6. Method of claim 1, comprising the further step of:

modifying the sear to change the point of release of the hammer by the sear.

7. Method of claim 6, wherein the step of modifying includes making the release point shorter.

8. Method of claim 6, wherein the step of modifying includes modifying the portion of the sear which engages the hammer to change the angle of engagement between the sear and the hammer.

9. Method claim 1, wherein the step of substantially decreasing the length of the trigger stroke includes replacing the trigger with another trigger having an abutment positioned so that the abutment is positioned between opposed portions of the trigger and the frame when the replacement trigger is installed in the pistol.

10. Method claim 1, wherein the step of substantially decreasing the length of the trigger stroke further includes the removable insertion of an abutment on a lower portion of the trigger for abutting another opposed portion of the frame so that length of the trigger stroke for firing said pistol is further reduced accordingly.

* * * * *